United States Patent [19]

Burns et al.

[11] Patent Number: 4,658,962

[45] Date of Patent: Apr. 21, 1987

[54] BAG DISPENSING CARTON

[75] Inventors: Ronald R. Burns, Naperville; Robert P. Graves, Jr., Downers Grove, both of Ill.

[73] Assignee: Viskase Corporation, Chicago, Ill.

[21] Appl. No.: 719,292

[22] Filed: Apr. 3, 1985

[51] Int. Cl.[4] ..... B65D 83/00

[52] U.S. Cl. ..... 206/554; 206/309; 221/45; 229/175; 229/23 BT

[58] Field of Search ..... 206/554, 390, 362, 409, 206/820, 499, 494, 497, 626, 526; 221/63, 71, 1, 45; 225/48, 50; 229/17 S, 17 R, 23 BT

[56] References Cited

U.S. PATENT DOCUMENTS

| | | | |
|---|---|---|---|
| 1,967,187 | 7/1934 | Dickson | 206/409 |
| 1,973,237 | 9/1934 | Vilas | 206/409 |
| 2,621,787 | 12/1952 | Harris | 229/175 |
| 2,758,710 | 8/1956 | Arens | 206/390 |
| 2,847,119 | 8/1958 | La Padura | 206/362 |
| 3,051,583 | 8/1962 | Tindall | 206/409 |
| 3,051,584 | 8/1962 | Tindall | 206/499 |
| 3,595,466 | 7/1971 | Rosenburg | 206/626 |
| 3,698,547 | 10/1972 | Roberts et al. | 206/820 |
| 3,884,335 | 5/1975 | Eriksson | 206/494 |
| 3,926,362 | 12/1975 | Beck et al. | 229/23 BT |
| 4,032,038 | 6/1977 | Hendricks et al. | 221/71 |
| 4,113,139 | 9/1978 | Berry et al. | 221/1 |
| 4,175,673 | 11/1979 | McDonald et al. | 221/63 |
| 4,306,653 | 12/1981 | Fales | 206/497 |
| 4,474,318 | 10/1984 | Perrin | 229/175 |

FOREIGN PATENT DOCUMENTS

| | | | |
|---|---|---|---|
| 0393199 | 6/1933 | United Kingdom | 229/17 R |

*Primary Examiner*—William Price
*Assistant Examiner*—Jimmy G. Foster
*Attorney, Agent, or Firm*—Roger Aceto

[57] ABSTRACT

A carton suitable for dispensing flat, flexible bags and the like, having a top cover comprising a top panel, opposing side walls, and an end wall formed by at least one inwardly folded end panel extending from one of the opposing side walls, the end panel being slightly shorter in height than the opposing side walls so that the end panel forms an elongated bag dispensing slot in the end wall along an edge of the top panel; and an elongated flap extending from the edge of the top panel and being folded inwardly to overlap the end panel, the flap being removably secured to the end panel, thereby adding strength to the end wall while at the same time covering the bag dispensing slot.

22 Claims, 7 Drawing Figures

BAG DISPENSING CARTON

BACKGROUND OF THE INVENTION

1. Field of the Invention

The present invention relates generally to bag dispensing devices. More particularly, the invention relates to an improved bag dispensing carton for dispensing a chain of flat, flexible bags of the type wherein the bags are easily removably attached to at least one continuous length of a flexible support member, such as an elongated sheet, ribbon or tape. Bag arrangements of this type are commonly referred to as "taped bags". They are particularly suited for use in packaging a variety of fresh and processed meat products in both manual and semi-automatic packaging operations.

2. Description of the Background Art

Taped bags are usually packaged in relatively large, telescoping cartons including a rectangular bottom tray and a top cover fitting over the tray. The bags are placed inside the bottom tray, preferably, though not necessarily, in plicated arrangement. An end of the flexible tape is placed on top of the bags where the tape is accessible to the user for pulling the bags from the carton.

The bags are packed tightly inside the carton in order to keep the bags in an orderly array and to prevent movement and abrasion damage to the bags. A band or tape is usually secured around the carton to retain the internal packing pressure on the bags during shipment and storage.

The problem arises, however, that when the bags are dispensed for use in a packaging operation, it is necessary to break the bands or tapes surrounding the carton, which immediately releases the packing pressure on the bags. When the top cover is then removed, the bags can go easily askew due to the sudden release of the restraint on them, and may even fall from the carton and collect in disorderly piles. This of course makes it difficult, if not impossible, to dispense the bags in an orderly fashion and without damage.

Bag dispensing cartons provided with an opening for dispensing bags therethrough are well known in the art. Such dispensing cartons are disclosed, for example, in U.S. Pat. Nos. 3,482,734 and 4,175,673. The advantage of these cartons is that they do not require removal of the top cover in order to dispense the bags. The bags are kept neatly packed inside the carton and are thus protected against damage.

The bag dispensing opening may be pre-cut in the top cover, for example, when the carton is assembled or the opening may be provided in the form of a perforated outline, that is, a series of spaced apart perforations made in the panel from which the top cover is constructed. The perforated outline can be easily broken and torn away from the panel to provide an opening of the desired size and shape to readily dispense the bags from the carton.

Although such bag dispensing cartons have been used extensively to package and dispense a variety of bag products, they do suffer a detriment in that the provision of the dispensing opening can seriously weaken the top cover and impair its ability to resist damage, particularly during shipment and storage of the carton. This is true even in either case where the opening is pre-cut or provided as a perforated outline. The series of perforations also weakens the top cover and it can be prematurely broken and torn away if the carton is severely handled or abused.

Dispensing cartons wherein the bags are tightly packed inside the carton to protect the bags, such as in the case of cartons for taped bags, are particularly susceptible to damage. The internal force exerted by the packaged bags on the top cover can cause the series of perforations to break or tear and prematurely open the carton. The series of perforations can be made of extraordinary strength to prevent the internal packing pressure from breaking the perforations, but such a remedy only serves to make the manual opening of the carton by the user more difficult. Furthermore, when the carton is made from relatively thick-sheet material, such as corrugated board, it is extremely difficult to provide perforations which will protect the contents and yet be easily severed or torn.

It is, therefore, an important object of the present invention to provide an improved telescoping bag dispensing carton particularly adapted for dispensing a chain of bags, which is economical and can be assembled at low cost, and which is strong and durable, and able to resist breakage and damage even when subjected to severe or abusive handling.

Another object of the present invention is to provide an improved telescoping bag dispensing carton which is simple in construction and easy to assemble, and which does not require a pre-cut opening or perforations, and which is able to dispense bags in a simple efficient manner.

Still another object of the present invention is to provide an improved telescoping bag dispensing carton wherein the opening for dispensing the bags is an elongated slot of relatively small size, but which, on the other hand, is large enough so that the bags can be dispensed without undesirable drag or abrasion damage, the elongated slot being located in an area of the top cover which does not seriously weaken the carton.

SUMMARY OF THE INVENTION

In accordance with the present invention, an improved telescoping bag dispensing carton is provided comprising:

a rectangular bottom tray;

a chain of flat, flexible bags disposed within the bottom tray;

a rectangular top cover telescopingly fitting over the bottom tray and including a top panel, opposing side walls, and an end wall formed by at least one inwardly folded end panel extending from one opposing side wall, the end panel being slightly shorter in height than the opposing side walls so that the end panel forms an elongated dispensing slot in the end wall along an edge of the top panel; and an elongated flap extending from the edge of the top panel and being folded inwardly to overlap the end panel, the flap being removably secured to the end panel, thereby adding strength to the end wall while at the same time covering the bag dispensing slot.

In a preferred embodiment of the carton, the top cover is formed with an end wall by two inwardly folded, overlapped end panels extending from both side walls, the end panels being slightly shorter in height than the opposing side walls so that when overlapped they form an elongated slot in the end wall for dispensing the bags.

DESCRIPTION OF THE PREFERRED EMBODIMENTS

Figure 1:
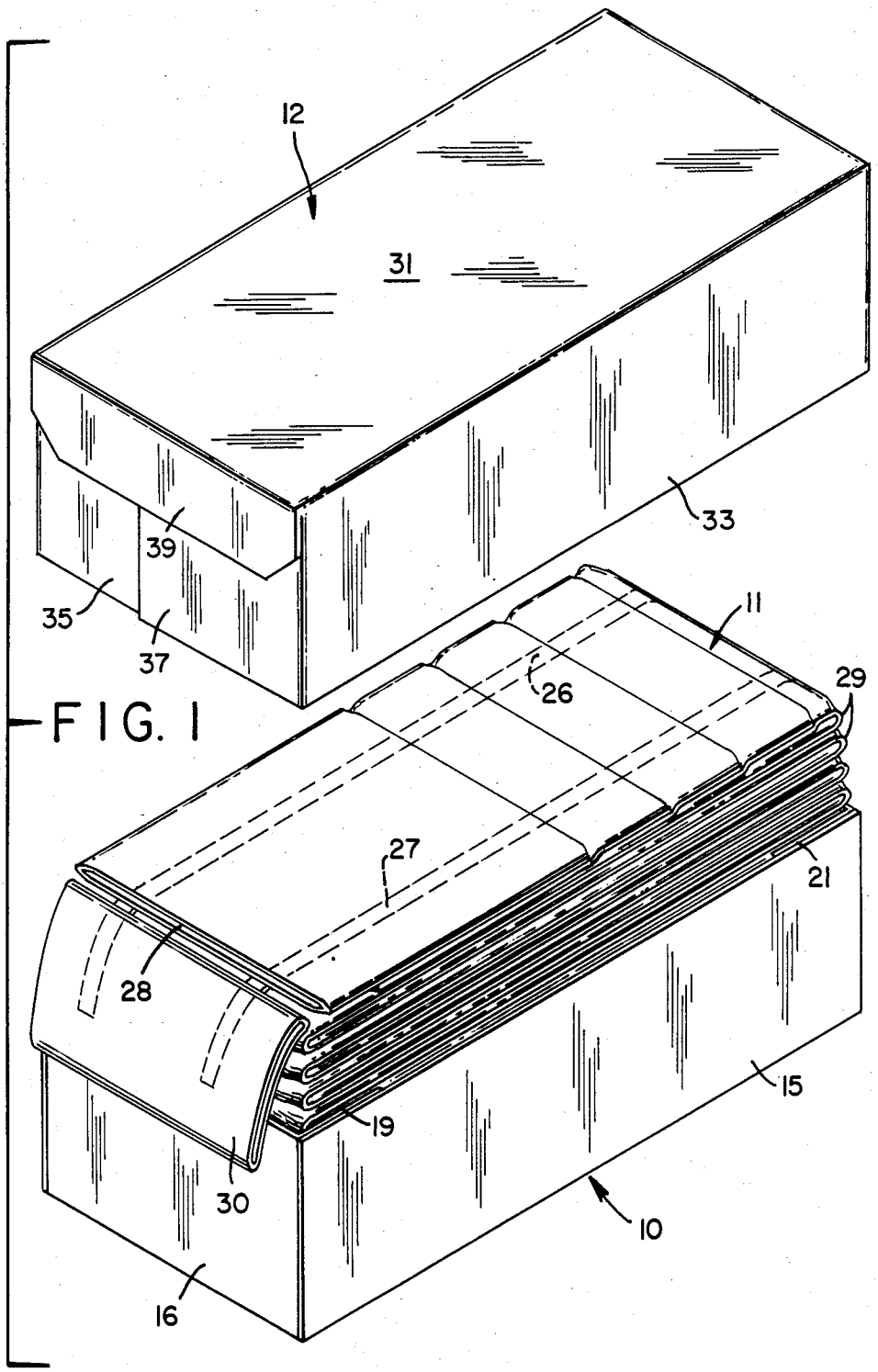
FIG. 1 is an exploded perspective view of a telescoping bag dispensing carton embodying the present invention, showing a rectangular bottom tray, a chain of taped, flexible, imbricated bags and a rectangular top cover.

Referring now to the drawings and particularly to FIG. 1, a telescoping bag dispensing carton embodying the present invention is shown comprising a rectangular bottom tray 10, a chain of taped, flexible imbricated bags 11 disposed inside the tray 10 and a rectangular top cover 12.

Figure 3:
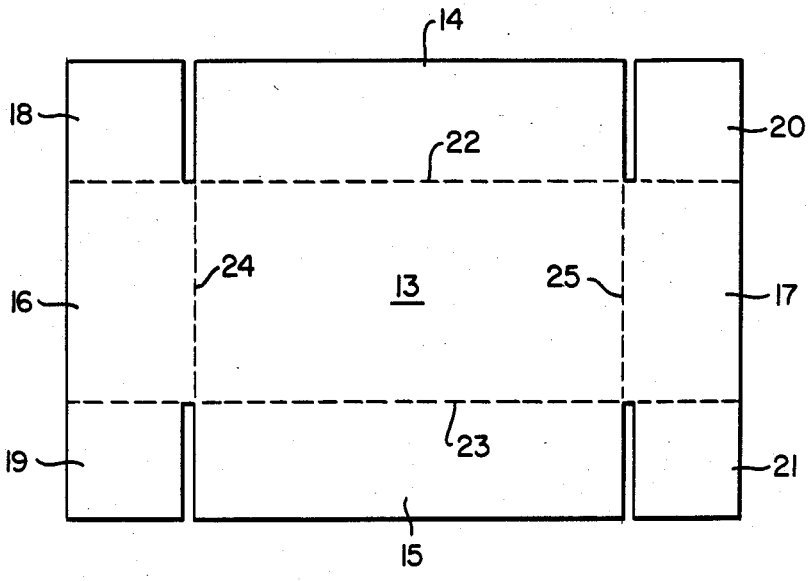
FIG. 3 is a plan view of a blank for forming the bqttom tray.

As shown in FIG. 3, the bottom tray 10 is formed from a blank which includes a rectangular bottom panel 13, two opposing side walls 14, 15, and two opposing end walls 16, 17. The two end walls 16, 17 are each similarly formed with two end flaps 18, 19 and 20, 21, respectively, depending from opposite ends thereof. The blank is cut from a relatively thick, foldable sheet material, such as a corrugated board, and fold lines are provided by scoring rules to facilitate folding the side and end walls as well as the end flaps during assembly of the tray.

The two side walls 14, 15 are folded upwardly 90° from the bottom panel 13, along the two fold lines 22, 23. The two end walls 16, 17 are similarly folded upwardly 90° from the bottom panel 13, along the fold lines 24, 25. The two depending end flaps 18, 19 are folded inwardly 90° from the end wall 16 and are glued to the inside of the side walls 14, 15 at the left hand end of the tray. In similar manner, the two depending end flaps 20, 21 are folded inwardly 90° from the end wall 17 and are glued to the inside of the side walls 14, 15 at the right hand end of the tray.

The bottom tray 10, as shown in FIG. 1, contains a chain of imbricated flat bags 11, each of which is removably attached to a pair of spaced apart, adhesive tapes 26, 27. Each bag 11 is arranged with its open mouth 28 facing toward the leading edge portion of the tapes 26, 27, thereby facilitating removal of the bags, particularly in semi-automatic packaging operations as hereinafter described.

As best shown in FIG. 1, the chain of imbricated bags 11 is folded back and forth upon itself in plicated arrangement as indicated at folds 29 when the bags are packaged inside the carton. The folds are made at intervals along the chain such that the entire packet of bags will fit snugly inside the bottom tray 10.

A leader 30, typically made from plastic such as a polyethylene tube or sheet, for example, is attached to the leading end portion of each adhesive tape 26, 27. The leader 30 hangs freely from the upper end of the plicated bag packet, i.e., the left hand end in this embodiment of the carton as shown in FIG. 1.

Figure 2:
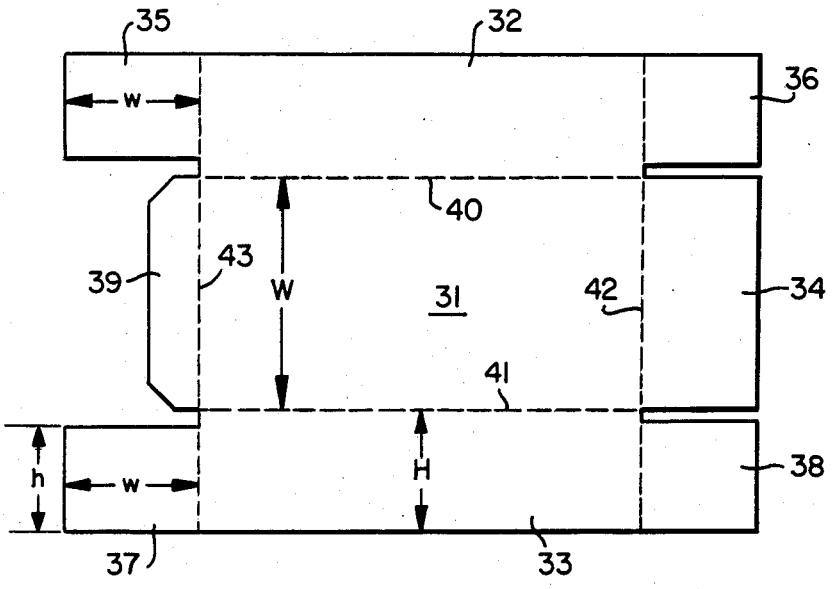
FIG. 2 is a plan view of a blank for forming the top cover.

As shown in FIG. 2, the top cover 12 is similarly made from a blank of foldable sheet material, such as a corrugated board, for example. The blank includes a rectangular top panel 31 which is neither broken or perforated, two opposing side walls 32, 33 and an end wall 34, located on the right hand side of the blank. The side walls 32, 33 are each provided with a pair of end panels 35, 36 and 37, 38, respectively, depending from opposite ends thereof.

At the left hand side of the blank, the top panel 31 is formed with an elongated end flap 39. The end flap 39 extends across the entire width of the top panel 31 and is made shorter in height than the opposing end wall 34.

The two side walls 32, 33 are folded upwardly (the top cover being conveniently assembled in inverted position) 90° from the top panel 31 along two fold lines 40, 41 provided by scoring rules as hereinbefore described. In similar manner, the end wall 34 is folded upwardly 90° from the top panel 31 along a fold line 42.

The two end panels 36 and 38, protruding from the two side walls 32 and 33 on the right hand side of the blank are each folded 90° inwardly along the same fold line 42 and are glued to the inside of the end wall 34.

The two end panels 35 and 37 protruding from the two side walls 32 and 33 on the left hand side of the blank are each folded 90° inwardly along a fold line 43 to overlap one another, and they are glued together to form the other end wall of the top cover 12.

Figure 4:
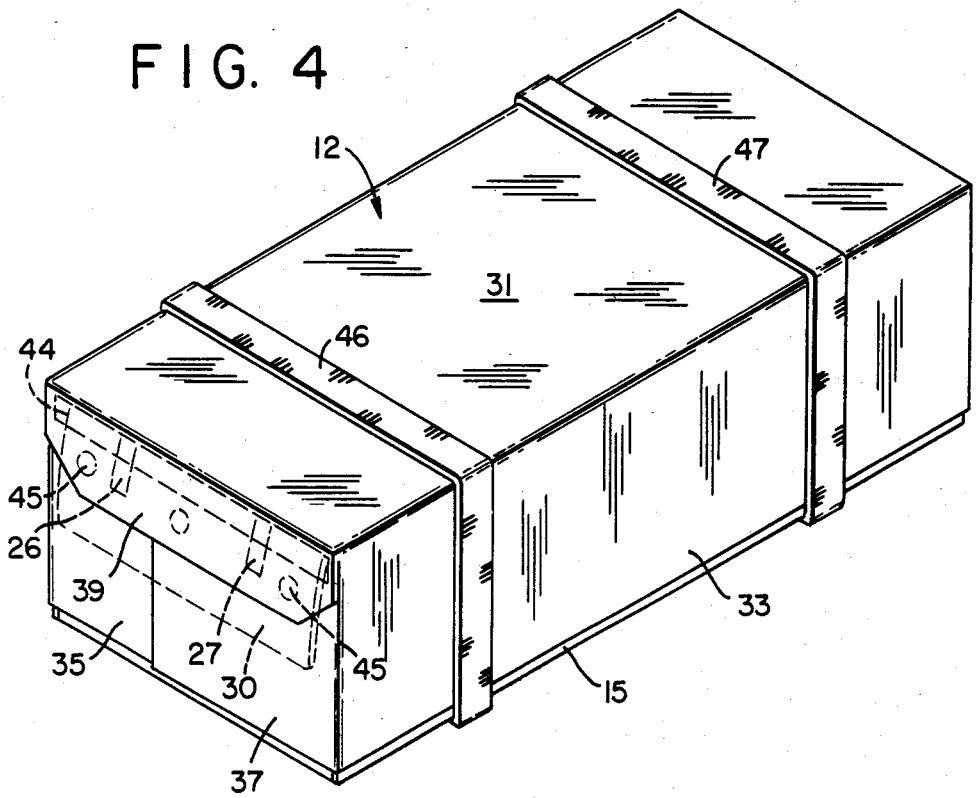
FIG. 4 is a perspective view of the assembled bag dispensing carton, showing an elongated flap overlying the bag dispensing slot provided in an end wall of the top cover.
Figure 5:
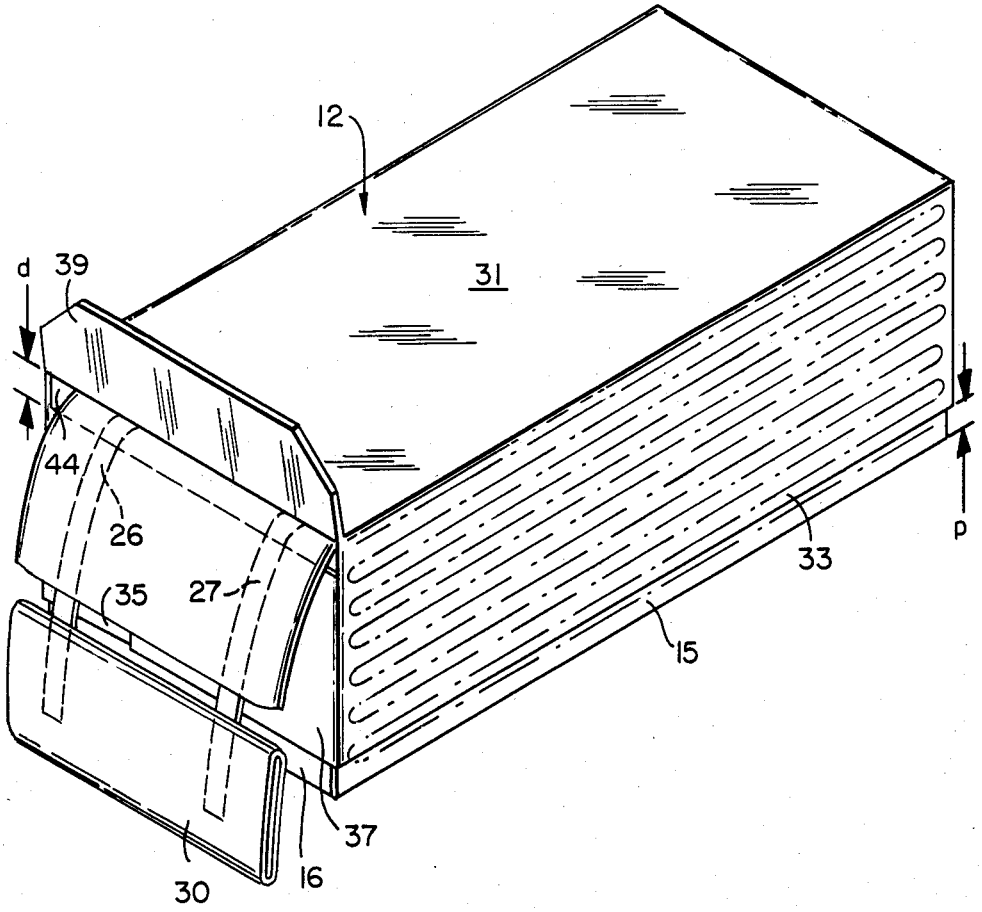
FIG. 5 is a perspective view of the assembled bag dispensing carton as shown in FIG. 4, but with the flap folded backward to expose the bag dispensing slot.

In the embodiment of the carton illustrated, each end panel 35, 37 is made to a width "w" which is greater than half the total width "W" of the top cover 12. The end panels 35, 37 are also dimensioned such that the overall height "h" of each tab as measured from its outer longitudinal edge, that is, the edge farthest from the top panel 31, is slightly less than the height "H" of each side wall 32, 33. Thus, when the two end panels 35, 37 are folded inwardly and overlapped as hereinabove described, they also form an elongated bag dispensing slot 44 located in the end wall just below the top panel 31 as best shown in FIGS. 4 and 5. The slot 44 extends across the entire width of the top panel 31 and is made to a depth "d" (FIG. 5) which allows passage therethrough of the chain of imbricated bags 11 from inside the carton.

To complete the assembly of the top cover 12, the end flap 39 is folded upwardly 90° from the top panel 31 along the fold line 43, and it then overlies the two overlapping end tabs 35, 37 as well as the bag dispensing slot 44. The end flap 39 is spot glued to both end tabs 35, 37 as shown at 45 (FIG. 4) providing a three-piece end wall structure for added strength and durability.

Although not shown in FIGS. 2 and 3, the dimensions of the top cover 12 are made slightly larger than those of the bottom tray 10 so that the top cover will telescopically fit over the side walls of the tray 10 during assembly of the carton. Moreover, the height of the side and end walls (except the end wall formed by overlapping panels 35, 37) are preferably, though not necessarily, made equal to the height of both the side and end walls on the bottom tray 10.

FIGS. 4 and 5 show the assembled carton with the top cover 12 telescopically fitting over the bottom tray 10. FIG. 4 shows the carton as it appears prior to being placed into use by the customer. FIG. 5, on the other hand, shows the carton as it appears during use with the elongated end flap 39, pulled free from the end tabs 35, 37 and folded back to expose the bag dispensing slot 44.

As shown in phantom lines in FIG. 4, the leader 30 attached to the leading edge of adhesive tapes 26, 27, is positioned behind the bag dispensing slot 44 between the end wall 16 of tray 10 and the corresponding end wall of top cover 12 which is formed by the overlapping end panels 35, 37. Preferably, the leader 30 is secured to the end wall 16 of the bottom tray 10 by a piece of adhesive tape, not shown.

A pair of bands 46, 47, suitably made of plastic or metal strapping or of a strong adhesive tape, are applied around the top cover 12, its side walls 32, 33 and the bottom panel 13 of the tray 10. These bands 46, 47 compress the plicated bag packet inside the carton and thus immobilize the chain of bags 11 to thereby prevent abrasion damage in handling and shipping.

To prepare the carton for use, the two bands 46, 47 surrounding the top cover 12 are removed and the elongated end flap 39 is folded back to expose the bag dispensing slot 44 as described hereinabove. The flap 39 is easily broken away from the end wall by reaching underneath the lower edge of the flap and applying sufficient outward pressure to sever the glue spots 45. The overlap of the end panels 35, 37 provides a convenient space to insert the user's finger to apply pressure under the flap 39.

Upon removal of the bands 46, 47, the top cover 12 will be lifted upwardly a short distance above the bottom tray 10, either by the internal pressure exerted by the bags 11 inside the carton, or by the dispensing process. The distance over which the top cover travels is shown at "p" in FIG. 5. This is the distance between the bottom edge of the tray 10 and the lower edge of top cover 12. It will be recalled that in this embodiment of the carton, the bottom tray 10 and top cover 12 are constructed with their respective side walls 15 and 33 being of substantially equal height. Thus, the distance "p" over which the top cover 12 travels once the bands 46, 47 are removed, should be at least equal to and is preferably greater than the depth "d" of bag dispensing slot 44 in the end wall of top cover 12. In this manner, the bag dispensing slot 44 will always be completely exposed for dispensing the chain of bags 11.

It is, of course, not necessary to construct the top cover 12 with opposing side walls 32, 33 which are equal in height to the height of side walls 14, 15 of the bottom tray 10. Such a construction is preferred, however, since the larger top cover 12 thus adds stacking strength and durability to the carton.

To dispense the bags, the user grasps the leader 30 located at the bag dispensing slot 44 and pulls the leader completely through the slot in order to expose the leading edge of the two flexible carrier tapes 26, 27. Any length of tape may then be pulled through the slot to remove a specified number of flat, flexible bags 11. Additional bags may be continually removed in this manner by a user at a desired rate according to the packaging operation. The carton may then be readily disposed of when the supply of bags 11 is depleted.

Figure 6:
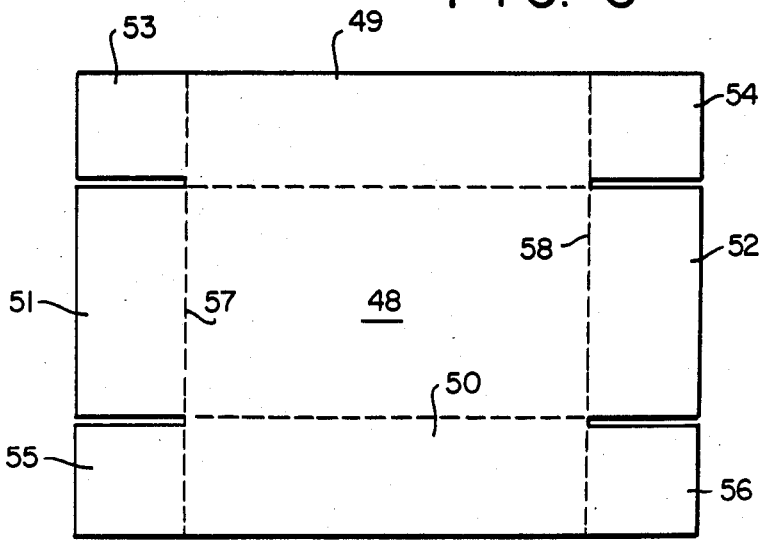
FIG. 6 is a plan view of a modified blank for forming the bottom tray.

FIG. 6 shows a modified blank from which the bottom tray 10 may be constructed. The blank comprises a rectangular bottom panel 48 having two opposing side walls 49, 50 and two opposing end walls 51, 52. The two opposing side walls 49, 50 are each formed with two depending end tabs 53, 54 and 55, 56, protruding from opposite ends thereof. When the blank is assembled into the tray, the end walls 51 and 52 are folded upwardly 90° along the fold line 57 and 58. Similarly, the two side walls 49, 50 are folded upwardly 90° along the fold lines 59, 60. The end tabs 53, 54 are then folded in and glued to the inside of each opposing end wall 51, 52.

Depending upon the particular dimensions of the carton, it may be more feasible to employ a bottom tray 10 of a construction shown in either FIGS. 3 or 6. A blank of the construction shown in FIG. 3 is generally preferred, however, since the end tabs are not limited by the width of the carton, assuming the length of the carton is always longer than the width. By forming the bottom tray 10 from the blank of FIG. 3 and the top cover 10 from the blank of FIG. 2, a double corrugation thickness is provided on the sides of the bottom tray and on the ends of the top cover so that a maximum compressive or stacking strength for the carton can be achieved.

Other modifications can of course be made in a bag dispensing carton according to the present invention. For example, it is entirely possible to construct the top cover with an end wall formed by only one end panel protruding from one side wall and having a height which is less than the height of the side wall so as to provide a bag dispensing slot in the manner as hereinabove described. However, such a modification requires a blank of a significantly larger size in order to accommodate the longer end panel that is needed to form the end wall during assembly of the top cover. Alternatively, of course, the top cover can be made of a two-piece construction, one piece including the top panel and opposing side walls, and the other piece including an end wall having a shorter height than the side walls to thereby provide a slot for dispensing bags from inside the carton.

Figure 7:
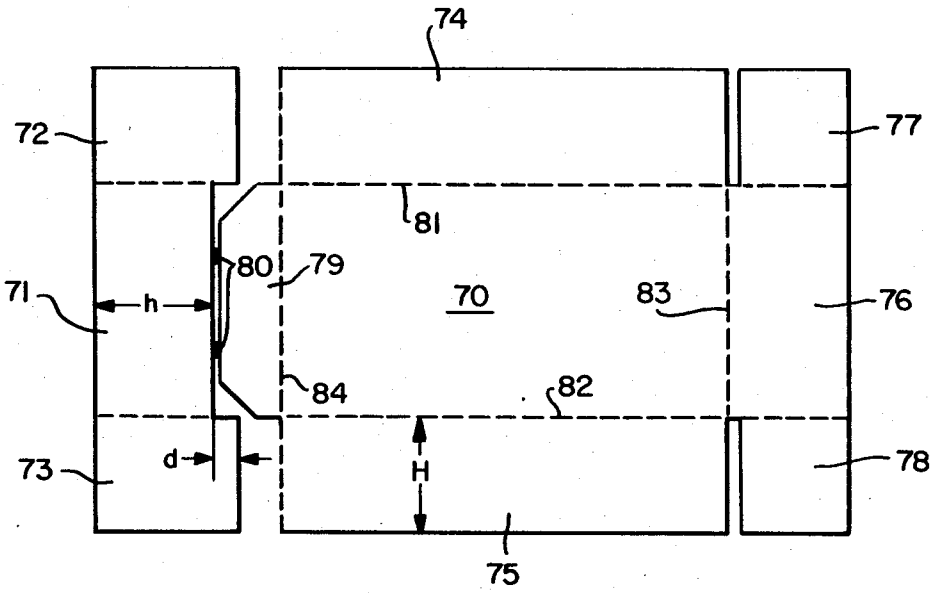
FIG. 7 is a plan view of a modified blank for forming the top cover.

Such a modification is shown, for example, in FIG. 7. As shown, the top cover is formed from a blank which comprises a top panel 70, two opposing side walls 74, 75, and a first end wall 76, located on the right hand side of the blank. The end wall 76 is provided with a pair of end tabs 77, 78.

At the left hand side of the blank, the top panel 70 is provided with an elongated end flap 79. The end flap 79 extends across the entire width of the top panel 70 and is made shorter in height than the opposing end wall 76.

An end panel 71 is attached to the flap 79 by small tabs 80. The end panel 71 has a pair of end tabs 72, 73. The height "h" of the end panel 71 is less than the height "H" of the opposing side walls 74, 75.

The two side walls 74, 75 are folded upwardly (the top cover being in inverted position) 90° from the top panel 70 along fold lines 81, 82 provided as hereinbefore described. The end wall 76 is folded upwardly 90° from the top panel 70 along fold line 83 and the end tabs 77, 78 are folded inwardly and secured to the inside of side walls 74, 75.

The end panel 71 is separated from flap 79 by tearing away tabs 80 and the end panel 71 is positioned 90° from the top panel 70 to form the other opposing side wall. End tabs 72, 73 are folded inwardly and secured to side walls 74, 75.

End flap 79 is then folded upwardly 90° from the top panel 70 and secured to end panel 71, thereby covering the slot which has been formed to a depth "d" as hereinabove described.

It is also possible to replace the bands 46, 47 with other similar means for holding the bags under compression inside the carton. For instance, a heat shrinkable overwrap could be employed for maintaining the carton intact when filled. Moreover, the chain of bags need not be limited to imbricated bags or a plicated arrangement of the bag pack inside the carton. Other forms of bag chains and packing arrangements can, of course, be employed.

A bag dispensing carton according to the present invention is ideally suited for use with apparatus for automatically delivering bags to a loading station, blowing the bags open, and inserting articles, such as meat products, inside the bags as disclosed, for example, in U.S. Pat. No. 3,619,969. The chain of imbricated bags is particularly suited to this type of operation since the open mouth of each bag becomes freely accessible to the air stream from the blower for opening the bags, as the preceding bag is dispensed from the chain of bags.

Although the present invention has been hereinabove described in connection with one embodiment wherein the bags have a length which is greater than the dimension of the bag mouth and the bag dispensing slot is provided in an end wall, it will be understood that the invention is not so limited, and that the bag dispensing slot and elongated flap can be provided as well in a side wall of the carton. Such an embodiment will be used when the bag mouth has a dimension which is greater than the length of the bag. Accordingly, therefore, as used herein the term "end wall" is defined to mean the wall of the carton wherein the bag dispensing slot is located, regardless of whether that wall has the shortest length or the longest length of all the carton dimensions, and the term "side wall" is defined to mean a wall of the carton which is attached to the herein defined end wall. Similarly, as used herein the term "end panel" refers to a panel which forms at least a portion of the herein defined end wall, and the term "side panel" refers to a panel which forms the herein defined side wall.

The present invention is also not restricted to cartons for dispensing taped bags alone, and it can be employed generally to dispense any bags of the type wherein the bags are removeably attached to a flexible carrier or otherwise releasably joined together, such as, for example, a continuous perforated bag strip.

A number of bag dispensing cartons have been made utilizing the principles of the present invention. For example, a typical carton for loading a packet of taped bags measuring 18 inches wide by 30 inches long is fabricated from 275 lbs. bursting strength B, C Flute double wall corrugated board, having outside dimensions of 20 inches wide by 27 inches long by 9½ inches high, one end having a one inch slot. The cartons were found to be durable and strong enough to resist damage, when subjected to ordinary as well as abusive handling, typical of conditions encountered during shipment, storage and use of the cartons.

What is claimed is:

1. A telescoping corrugated board carton including a bottom tray with an upstanding peripherial wall and a top cover telescoped over said bottom tray, said top cover comprising:

(a) a top panel having depending side and end walls joined at common edges and telescopingly fitted over said bottom tray;

(b) one of said end walls being shorter in height than the depending side walls joined to said one end wall so that an upper edge of said one end wall is spaced below said top panel, said upper edge and an adjacent edge of said top panel defining an elongated dispensing slot therebetween which is immediately below said top panel and which extends the full width of said one end wall;

(c) an elongated flap extending from said edge of said top panel and folded downwardly to overlap said one end wall and close said elongated slot; and (d) adhesive means for removably securing said flap to said one end wall, said adhesive means and elongated flap together providing stacking strength for said carton when said flap is secured to said one end wall.

2. A carton according to claim 1 wherein said one end wall is formed by at least one inwardly folded panel extending from one of said opposing side walls.

3. A carton according to claim 2 wherein said one end wall is formed by two inwardly folded overlapped panels extending from said opposing side walls.

4. A carton according to claim 1 wherein said one end wall is formed by a separate one-piece panel having end tabs protruding therefrom which are secured to said opposing side walls.

5. A telescoping bag dispensing carton comprising in combination:

(a) a bottom tray composed of a bottom panel, upstanding side and end walls, and an open top;

(b) a top cover telescopingly fitted over said bottom tray and composed of a top panel, depending side and end walls, and an open bottom;

(c) said top cover having one of its end walls formed by an end panel extending from one of said depending side walls, the height of said end panel being less than the height of said depending side walls so that an upper edge of said end panel is spaced below an edge of said top panel to define an elongated dispensing slot therebetween;

(d) a flap member extending from said edge of said top panel and folded downwardly over said end panel and being releasably secured to said end panel to close said slot;

(e) a bag stack disposed in said bottom tray for dispensing through said slot, said bag stack composed of a folded chain of flat imbricated bags removably attached to at least one continuous length of flexible tape, and said bag stack having an uncompressed height which is greater than the depth of said bottom tray, and the difference between the uncompressed stack height and depth of the bottom tray being at least equal to the height of said dispensing slot;

(f) releasable binding means about said top cover and bottom tray for holding said bag stack within said carton under a compressive pressure and maintaining said top cover and bottom tray in a first relative position wherein said dispensing slot is occluded by an adjacent upstanding end wall of said bottom tray, and said top cover being movable to a second position relative to said bottom tray responsive to upward expansion of said bag stack to its uncompressed height upon release of said binding means.

6. A bag dispensing carton according to claim 5 wherein said one end wall is formed by two inwardly folded, overlapped end panels extending from said opposing side walls, both end panels being slightly shorter in height than said opposing side walls, so that when overlapped they form said elongated bag dispensing slot.

7. A bag dispensing carton according to claim 5 wherein said one end wall is formed by a separate one-piece panel having end tabs protruding therefrom which are secured to said opposing side walls.

8. A bag dispens1ng carton according to claim 5 whererein the chain of bags comprises a plurality of imbricated bags attached to a pair of spaced apart, flexible adhesive tapes.

9. A bag dispensing carton according to claim 5 wherein the chain of bags is folded back and forth upon itself in plicated arrangement in said bottom tray.

10. A bag dispensing carton according to claim 5 wherein the means for maintaining the packing pressure comprises at least one band surrounding the top cover and bottom tray.

11. A bag dispensing carton according to claim 5 wherein a leader is attached to the leading edge of said chain of bags and positioned between adjacent end walls of said top cover and bottom tray and behind said bag dispensing slot.

12. A bag dispensing carton according to claim 5 wherein the side walls of said top cover are substantially equal in height to the side walls on said bottom tray.

13. A telescoping bag dispensing carton comprising:

a rectangular bottom tray made from corrugated board:

a chain of flat, flexible, imbricated bags removably attached to at least one continuous length of flexible tape, the chain of taped bags being disposed in plicated arrangement within said bottom tray;

a rectangular top cover made from corrugated board, including a flat, unbroken, top panel having two rectangular side walls extending outwardly from two opposing side edges, said side walls being each infolded 90° from said top panel and including a rectangular end panel protruding from an edge of each side wall traversed to said top panel, the end panel protruding from each side wall being infolded 90° therefrom toward the opposite side wall and overlapping the end panel infolded from said opposite side wall, thereby forming an end wall of said top cover, each end panel having a height which is shorter than the height of the corresponding side wall from which it protrudes so that, when overlapped, the end panels form an elongated slot located beneath an edge of said top panel adjoining said end wall for dispensing the chain of bags therethrough wherein said top cover has sufficient durability and strength to withstand compression and provide stacking strength to said carton; and an elongated flap extending from said edge of said top panel adjacent to said end wall and being infolded 90° therefrom to overlap said end panels, said flap being spot glued to said end panels, thereby adding strength to said end wall while at the same time covering said slot and protecting said bags inside said carton.

14. A pair of blanks made from a foldable material adapted to be formed into a telescoping bag dispensing carton including a rectangular bottom tray and a rectangular top cover, comprising:

a first blank including:

a rectangular bottom panel defined by two opposing pairs of fold lines:

a pair of opposing side walls connected to said bottom panel along one of said pair of opposing fold lines;

a pair of opposing end walls connected to said bottom panel along the other of said pair of said fold lines;

a pair of end tabs protruding from the side edges of at least one of said pair of side walls or said pair of end walls and connected thereto along a pair of fold lines which are normal to said pair of opposing fold lines connecting said walls to said bottom panel, said end tabs adapted to be secured to the other of said pair of side walls or said pair of end walls when folded upwardly 90° from said bottom panel; and a second blank including:

a rectangular top panel including a pair of opposing side walls connected along a pair of opposing fold lines to said top panel;

a pair of end panels, each of which is connected to a side wall along a fold line normal to the fold lines connecting said side walls to said top panel, said pair of end panels adapted to be folded 90° inwardly to overlap the other one of said pair of end panels folded 90° inwardly from the opposing side wall, thereby forming an end wall of said top cover, the height of said pair of end panels being shorter than the height of said pair of side walls so that when said end panels are folded and overlap one another, they form an elongated slot in the end wall just beneath the top panel for dispensing bags from inside the carton; and an elongated flap connected along a fold line to said top panel and adapted to be folded 90° therefrom to cover said elongated bag dispensing slot.

15. A pair of blanks according to claim 14 wherein the pair of end tabs are connected along fold lines to said pair of side walls.

16. A pair of blanks according to claim 14 wherein the pair of end tabs are connected along fold lines to said pair of end walls.

17. A set of blanks made from a foldable material adapted to be formed into a telescoping bag dispensing carton including a rectangular bottom tray and a rectangular top cover, comprising:

a first blank including:

a rectangular bottom panel defined by two opposing pairs of fold lines:

a pair of opposing side walls connected to said bottom panel along one of said pair of opposing fold lines;

a pair of opposing end walls connected to said bottom panel along the other of said pair of said fold lines;

a pair of end tabs protruding from the side edges of at least one of said pair of side walls or said pair of end walls and connected thereto along a pair of fold lines which are normal to said pair of opposing fold lines connecting said walls to said bottom panel, said end tabs adapted to be secured to the inner side of the other of said pair of side walls or said pair of end walls when folded upwardly 90° from said bottom panel;

a second blank including:

a rectangular top panel including a pair of opposing side walls connected along a pair of opposing fold lines to said top panel;

an elongated flap connected along a fold line to said top panel; and, a third blank including:

an end panel adapted to be positioned in a plane 90° from said top panel so as to form an end wall of said top cover, said end panel having a pair of end tabs protruding from opposite sides thereof and adapted to the folded 90° inwardly and secured to the opposing side walls of said top panel, the height of said end panel being shorter than the height of said opposing side walls.

18. A set of blanks according to claim 17 wherein said third blank is attached to said second blank by at least one severable tab.

19. A set of blanks according to claim 18 wherein said third blank is attached to said elongated flap.

20. A carton according to claim 5 wherein said bottom tray has sufficient durability and strength to withstand compression and provide stacking strength to said carton.

21. A carton according to claim 13 which further comprises means for maintaining said carton under compressive pressure.

22. A carton according to claim 21 wherein at least one band surrounding the top cover and bottom tray comprises the means for maintaining said carton under compressive pressure.

* * * * *